US008096857B2

(12) United States Patent
Hofmann et al.

(10) Patent No.: US 8,096,857 B2
(45) Date of Patent: Jan. 17, 2012

(54) POWER TOOL, IN PARTICULAR ANGLE GRINDER

(75) Inventors: Albrecht Hofmann, Steinenbronn (DE); Harald Krondorfer, Mundelein, IL (US); Markus Heckmann, Leinfelden-Echterdingen (DE); Kersten Heckmann, legal representative, Leinfelden-Echterdingen (DE); Thomas Schomisch, Leinfelden-Echterdingen (DE)

(73) Assignee: Robert Bosch GmbH, Stuttgart (DE)

( * ) Notice: Subject to any disclaimer, the term of this patent is extended or adjusted under 35 U.S.C. 154(b) by 106 days.

(21) Appl. No.: 10/512,715

(22) PCT Filed: Jun. 6, 2003 (Under 37 CFR 1.47)

(86) PCT No.: PCT/DE03/01887

§ 371 (c)(1), (2), (4) Date: May 19, 2006

(87) PCT Pub. No.: WO2004/026535

PCT Pub. Date: Apr. 1, 2004

(65) Prior Publication Data

US 2007/0007026 A1 Jan. 11, 2007

(30) Foreign Application Priority Data

Sep. 13, 2002 (DE) ..... 102 42 738

(51) Int. Cl.
*B24B 23/02* (2006.01)

(52) U.S. Cl. ..... 451/359; 451/344; 451/358

(58) Field of Classification Search ..... 451/344, 451/294, 353, 359, 259, 354, 358; 74/89.1, 74/424

See application file for complete search history.

(56) References Cited

U.S. PATENT DOCUMENTS

| | | | | | |
|---|---|---|---|---|---|
| 1,971,790 | A | * | 8/1934 | Mall | 451/359 |
| 4,356,669 | A | * | 11/1982 | Hoglund | 451/239 |
| 4,672,776 | A | * | 6/1987 | McCullough | 451/143 |
| 4,736,546 | A | * | 4/1988 | Ugo | 451/254 |
| 4,742,257 | A | * | 5/1988 | Carpenter | 310/62 |
| 4,955,744 | A | * | 9/1990 | Barth et al. | 403/259 |
| 5,077,942 | A | * | 1/1992 | Jacobsson | 451/344 |
| 5,170,851 | A | * | 12/1992 | Kress et al. | 173/29 |
| 5,317,838 | A | * | 6/1994 | Bourner | 451/294 |
| 5,398,454 | A | | 3/1995 | Berner | |
| 5,564,969 | A | * | 10/1996 | Tsang | 451/358 |
| 5,580,302 | A | * | 12/1996 | Howard et al. | 451/357 |
| 5,624,000 | A | | 4/1997 | Miller | |
| 5,718,621 | A | * | 2/1998 | Turley | 451/342 |
| 5,839,950 | A | * | 11/1998 | Johansson Edling et al. | 451/359 |
| 5,947,805 | A | * | 9/1999 | Van Osenbruggen | 451/358 |
| 6,048,260 | A | | 4/2000 | Kopras | |
| 6,120,362 | A | * | 9/2000 | Etter et al. | 451/354 |
| 6,244,943 | B1 | * | 6/2001 | Bohler et al. | 451/294 |

(Continued)

FOREIGN PATENT DOCUMENTS

| | | |
|---|---|---|
| CN | 1204567 | 1/1999 |

(Continued)

*Primary Examiner* — Timothy V Eley
(74) *Attorney, Agent, or Firm* — Michael J. Striker

(57) ABSTRACT

A power tool, in particular a right-angle grinder, includes a motor and a gear, the motor and/or the gear embodied as a mountable function module. The gear is embodied as a mountable function module, with a gear input shaft supported in a gearbox, and the gear input shaft is fixed in the gearbox via at least one detent connection.

13 Claims, 8 Drawing Sheets

U.S. PATENT DOCUMENTS

| | | | | |
|---|---|---|---|---|
| 6,375,171 | B1 * | 4/2002 | Zimmermann et al. | 267/137 |
| 6,386,961 | B1 * | 5/2002 | Cureton | 451/358 |
| 6,464,572 | B2 * | 10/2002 | Jansson | 451/344 |
| 6,543,926 | B2 * | 4/2003 | Sherez | 366/108 |
| 6,734,584 | B1 * | 5/2004 | Browne et al. | 310/58 |
| 6,840,353 | B2 * | 1/2005 | Arisaka | 188/83 |
| RE38,878 | E * | 11/2005 | Hirose et al. | 451/288 |
| 7,204,744 | B2 * | 4/2007 | Lamprecht et al. | 451/357 |
| 7,270,641 | B2 * | 9/2007 | Glucksman et al. | 601/112 |
| 7,541,701 | B2 * | 6/2009 | Lin et al. | 310/58 |
| 2001/0031616 | A1 * | 10/2001 | Jansson | 451/344 |
| 2004/0035652 | A1 * | 2/2004 | Arisaka | 188/83 |
| 2004/0263008 | A1 * | 12/2004 | Voigt et al. | 310/58 |
| 2005/0281687 | A1 * | 12/2005 | Frauhammer et al. | 417/366 |
| 2006/0084370 | A1 * | 4/2006 | Robieu et al. | 451/359 |
| 2006/0175915 | A1 * | 8/2006 | Voigt et al. | 310/58 |

FOREIGN PATENT DOCUMENTS

| | | | |
|---|---|---|---|
| DE | 1 103 804 | | 3/1961 |
| DE | 40 04 464 | | 1/1991 |
| DE | 40 00 861 | | 7/1991 |
| DE | 40 00 861 | A1 | 7/1991 |
| DE | 42 23 107 | | 1/1994 |
| DE | 4233948 | A1 * | 4/1994 |
| EP | 0 829 237 | A2 | 3/1998 |
| EP | 0 890 420 | | 1/1999 |
| EP | 0 890 420 | A1 | 1/1999 |
| JP | 63-140357 | | 9/1988 |
| JP | 7-224845 | | 8/1995 |
| JP | 8-52669 | | 2/1996 |
| JP | 10-29173 | | 2/1998 |
| JP | 11-75931 | | 3/1999 |
| WO | 01/02117 | | 1/2001 |

* cited by examiner

POWER TOOL, IN PARTICULAR ANGLE GRINDER

BACKGROUND OF THE INVENTION

Prior art with respect to the general construction:

Angle grinders, in particular those for one-handed operation, typically have an electric motor comprising a pole piece and an armature as well as a bevel gear, comprising a pinion, ring gear, and work spindle. The armature shaft is supported in the motor housing, and the pole piece is usually press-fitted into this housing. The brush holders are likewise as a rule secured in the motor housing. The motor cannot be operated outside the motor housing, since the motor housing has the function of positioning the components relative to one another.

The pinion is seated directly on the armature shaft of the motor. The gear can likewise not be operated without the armature shaft, since this shaft takes on the function of a gear input shaft.

Further, prior art with respect to the gear:

The right-angle gear of an electrically operated angle grinder has the tasks of deflecting the flow of force by 90° C. and stepping down the rpm of the typically high-speed electric motor to the lower working rpm.

The drive pinion is typically secured directly to the armature shaft of the electric motor and drives the power takeoff spindle via a ring gear. The spindle is supported in the gearbox at two bearing points, one on either side of the ring gear. The bearing points of the motor shaft are typically located in the gearbox and in the motor housing. The fixed bearing of the motor shaft is typically disposed between the pinion and the fan on the armature shaft, while the loose bearing is located on the shaft end toward the collector. The result is accordingly an assembly with a "floating" pinion.

Further, prior art with respect to the motor mount:

Electric tools typically have an electric motor, comprising a pole piece and an armature, and the armature shaft is supported in the motor housing, and the pole piece is typically press-fitted into that housing. The brush holders are likewise as a rule secured in the motor housing.

SUMMARY OF THE INVENTION

Further, the object of the invention with respect to the general construction and the gear:

Making a modular construction for a power tool, in particular an angle grinder possible; making assembly easier and improving the ease of servicing, as well as supporting modular systems.

To reduce assembly costs, the ease of assembly has particular significance.

Further, the object of the invention with respect to the motor mount:

Accommodating a completely supported electric motor, in particular an encapsulated DC motor, in a shell housing. The receptacle should position the motor in the housing, compensate for errors in position, and elastically cushion and damp impacts.

Further, the object of the invention with respect to the connection between the motor and the gear:

Structurally simple realization of a modular construction for an angle grinder to make assembly easier and improving ease of servicing as well as supporting modular systems.

If a completely supported motor ("cam motor") is used in an angle grinder, then advantageously a modular construction is selected, with a motor and a gear as independent functional component groups. These groups should be joined together via the most economical possible coupling. This coupling should furthermore, especially within certain limits, be capable of compensating for an axial offset and an angle error between the armature shaft and the gearbox. The coupling described in the invention attains these objects.

Advantages of the invention over what is known with respect to the general construction:

A modular construction of electric tools facilitates assembly of the tool and makes servicing easier, since individual components can be replaced simply and quickly.

The development of modular systems is supported by a modular construction.

Further, advantages of the invention over what is known with respect to the gear:

A gear of the invention, in contrast to the versions in known angle grinders, has an independent, fully functional component group that can easily be combined with other component groups (such as the motor).

Mounting the pinion shaft with bearing points on both sides of the drive pinion, in particular in the gearbox, makes better absorption of the gear forces possible than do the usual versions with a "floating" pinion. The assembly of the pinion shaft is done without screws, by simply inserting parts into one another. This makes savings in terms of assembly costs possible. The type of assembly presented makes it possible to mount a preassembled subsidiary component group comprising the pinion shaft, pinion, ball bearing and press-fitted fan and simultaneously secure it axially.

Further, advantages of the invention over what is known with respect to the motor mount:

Compared to the known installation situations, the proposed version offers the advantage that the rubber rings provided in the bearing points, because of their resilient and damping properties, are capable of damping impacts and vibration and thus positively affect the service life and operating properties of the tool.

In addition, the rubber rings make it possible to compensate for axial errors; that is, the rubber rings act as a damping unit and at the same time as a compensation coupling. Especially advantageously, the proposed version can be used in a modular construction of the electric tool. Further, while this version is conceivable in various motors that appear suitable to one skilled in the art, it is especially advantageous in battery-operated motors.

Further, advantages of the invention over what is known with respect to the connection between the motor and the gear:

A modular construction of electric tools facilitates assembly of the tool and makes servicing easier, since individual components can be replaced simply and quickly.

The development of modular systems is supported by a modular construction. The coupling described is especially economical. Beyond its actual function, additional functions such as damping of jerking can also be integrated. Further, via the coupling, an advantageous lengthening of a short armature shaft, particularly of a cam motor, can be made possible, so that an angle grinder can advantageously be flanged on. Because of the coupling, standard motors can advantageously be used.

DETAILED DESCRIPTION OF THE PREFERRED EMBODIMENTS

Figure 1:
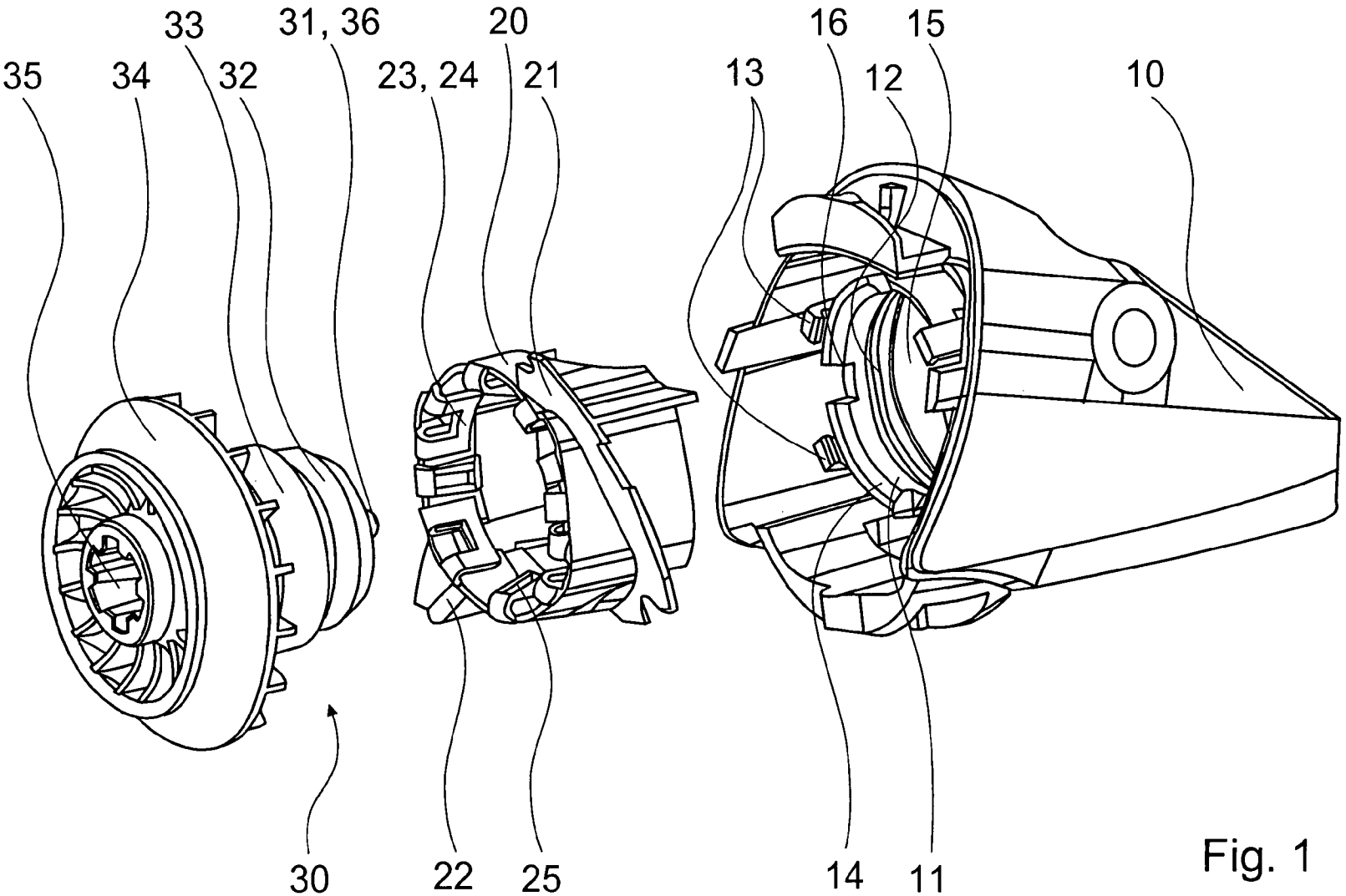
FIG. 1 is a perspective view showing a power tool in accordance with the present invention with a gear box, a fan guide wheel and a subsidiary component group.

FIG. 1 shows the gearbox 10, the fan guide wheel 20, and a subsidiary component group 30 that comprises a pinion shaft 31, pinion 32, ball bearing 33, and fan 34.

The subsidiary component group 30 is preassembled by first thrusting the ball bearing 33 onto the pinion shaft 31 and then press-fitting the pinion 32 on. The fan 34 is press-fitted onto the opposite end of the shaft and has an internal toothing 35 that takes on the coupling function. For the later installation of the component group 30 in the gearbox 10, it is necessary for the pinion 32 to have a smaller diameter, by several millimeters, than the ball bearing 33.

A bearing bush or a needle bearing (not shown in the drawing) is first press-fitted into the gearbox 10. This bearing bush or needle bearing forms the loose bearing for the pinion shaft 31. Next, an O-ring is placed in the groove 12 in the bearing seat 11 to seal off the ball bearing 33.

Figure 2:
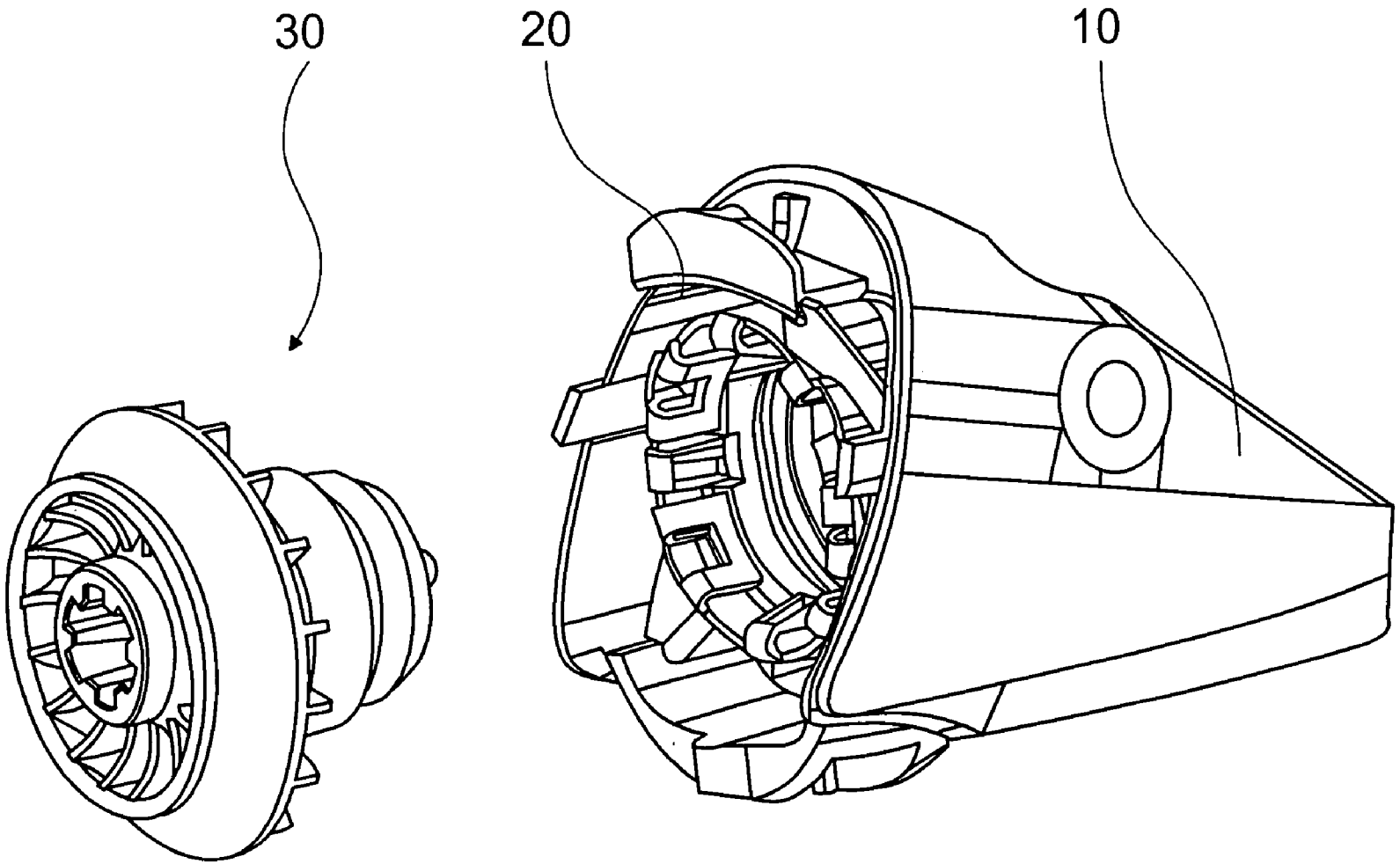
FIG. 2 is a view substantially corresponding to the view of FIG. 1, but in which the fan guide wheel is inserted in the gear box.

The fan guide wheel 20 performs a dual function: First, the laterally protruding faces 21, 22 cover hollow chambers in the gearbox and direct a cooling air of the motor to the air outlet openings in the gearbox. Second, the fan guide wheel 20 takes on the task of axially securing the ball bearing 33 in its bearing seat 11 in the gearbox. For assembly, the fan guide wheel 20 is pressed into the gearbox; FIG. 2. In the process, four tabs 23 on the guide wheel 20 engage corresponding hooks 13 on the gearbox 10 from behind. The fan guide wheel is thus clipped in place.

Corresponding chamfers 14, 24 on the gearbox 10 and on the tabs 23 of the fan guide wheel 20 assure that the fan guide wheel 20 is pressed to the rear (in the direction A) until the tabs 23 rest on the corresponding faces of the hooks 13. The axial play required for clipping the fan guide wheel in place is thus eliminated by the elastic bracing of the fan guide wheel 20.

For assembly of the component group 30, this group is clipped into the fan guide wheel 20. In the process, the shaft end 36 slides into the needle bearing (not shown) that has been press-fitted into the gearbox, and the ball bearing 33 slides into the corresponding bearing seat 11 in the gearbox. The outer ring of the ball bearing 33 in the process thrusts four snap hooks 25 radially outward into corresponding recesses 16 in the gearbox 10. In the final position, the outer ring of the ball bearing 33 rests on a contact shoulder 15 in the gearbox. The snap hooks 25 can pivot back inward again into their unloaded outset position and thus prevent a displacement of the outer ring of the ball bearing 33 in the axial direction A. FIG. 3 shows the assembled gear component group. The fan 34 is not shown in this view, to make the fan guide wheel 20 with the snap hooks 25 snapped into place visible.

Figure 5:
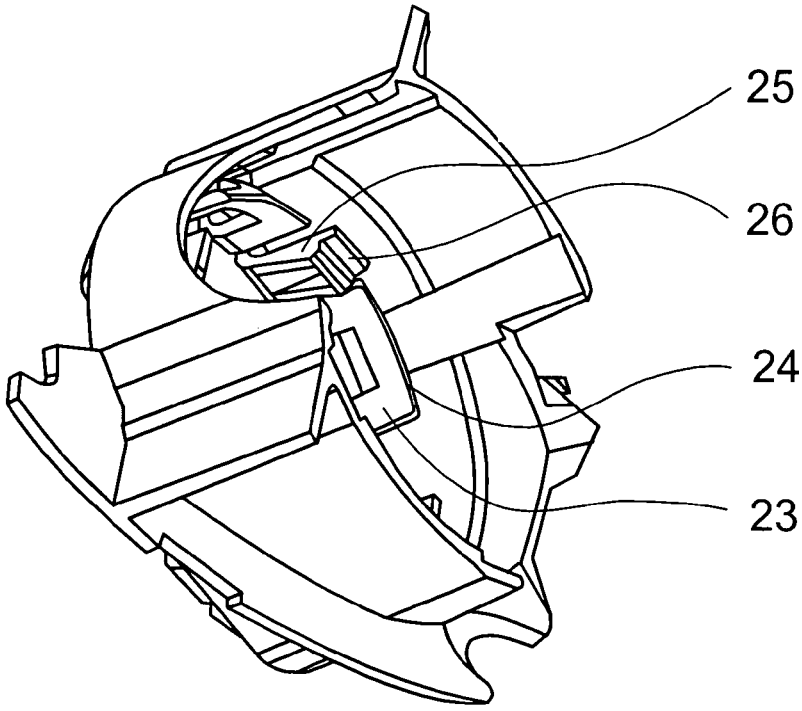
FIG. 5 is a perspective view of the fan guide wheel with its components as seen from another side.

The axial gear forces that occur in operation act in the direction A on the snap hooks 25. The snap hooks 25 are designed such that in the relaxed state (that is, after the component group 30 has been inserted), they have a slight inward radial positioning inward. The snap hooks 25 are thereby prevented from deflecting radially outward again solely on the basis of an axial force in the direction A. Because of their geometry, the snap hooks 25 have the tendency of deflecting radially inward to avoid a force from direction A. To prevent the axial play of the component group 30 from increasing impermissibly as a result of the operative gear forces, stop cams 26 are disposed on the ends of the snap hooks 25; in the assembled state, these cams fit around the outer ring of the ball bearing 33; see FIG. 5.

Since in the assembled state the snap hooks 25 and the tabs 23 are hidden by the fan 34, dismantling the gear component group 30 without destroying it is impossible. To remove the component group 30 from the gearbox 10, the component group 30 is leveraged out of the gearbox 10 in the direction A. In the process, the snap hooks 25 at the fan guide ring 20 break. Once the component group 30 has been removed, the destroyed fan guide ring 20 can be removed from the gearbox 10 by either breaking out the tabs 23 or bending them back. In principle, however, nondestructive dismantling would also be conceivable.

Figure 1A:
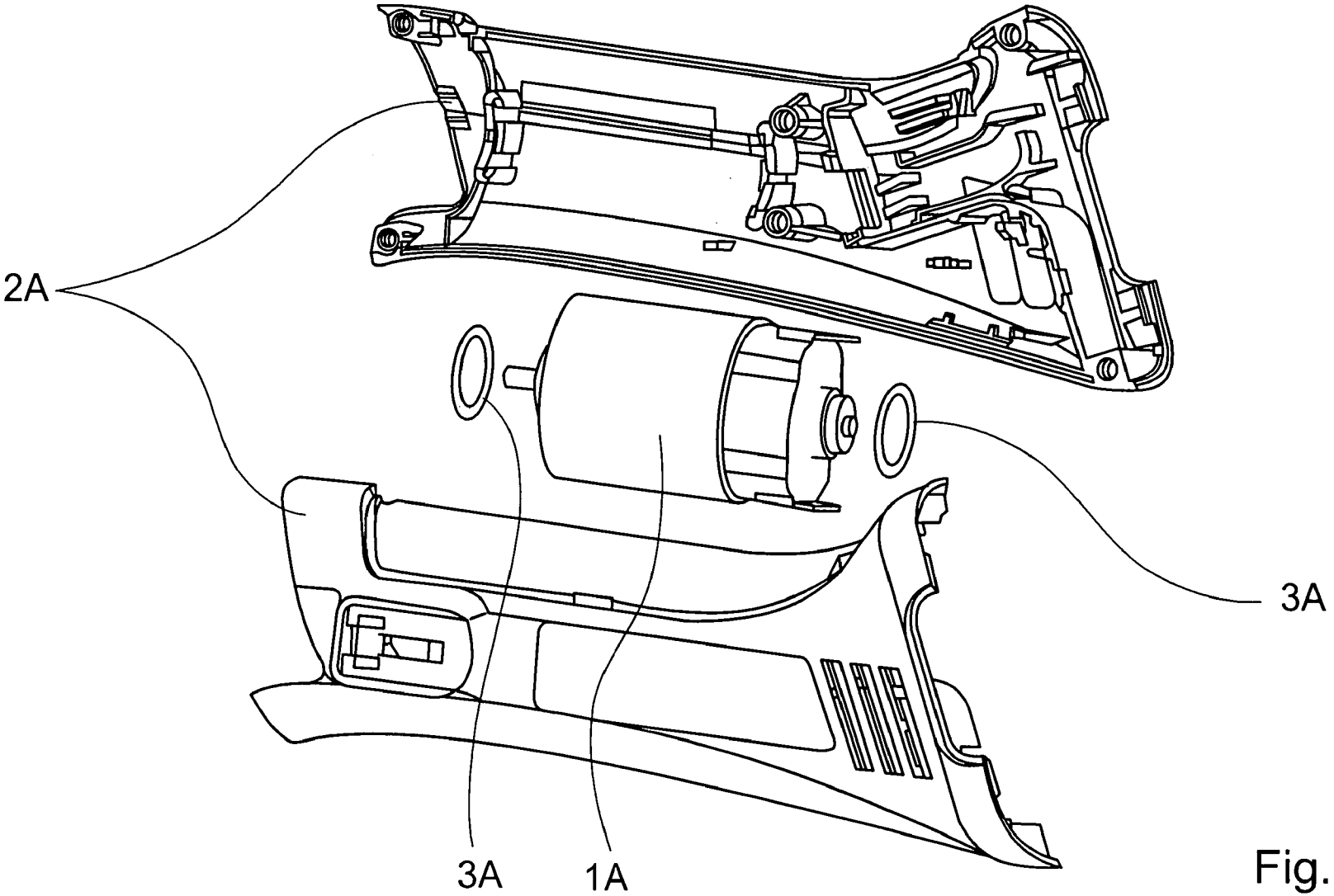
FIG. 1A is a view showing an exemplary embodiment of a motor housing of the tool in form of a shell housing.

Description of FIG. 1A:

FIG. 1A shows as an exemplary embodiment the motor housing (2A) of an electric tool in the form of a shell housing. The motor (1A) is supported completely as a unit (encapsulated motor) and is also functional even outside the motor housing (2A).

The motor (1A), on its front and rear ends, has cylindrical receiving domes. Before the motor (1A) is placed in the housing shells, O-rings that fit and are made of rubber (3A) are thrust over these receiving domes.

When the housing shells are screwed together, the rubber rings are clamped in place and enable effective damping of vibration and impacts as well as compensation for tolerances.

Figure 1B:
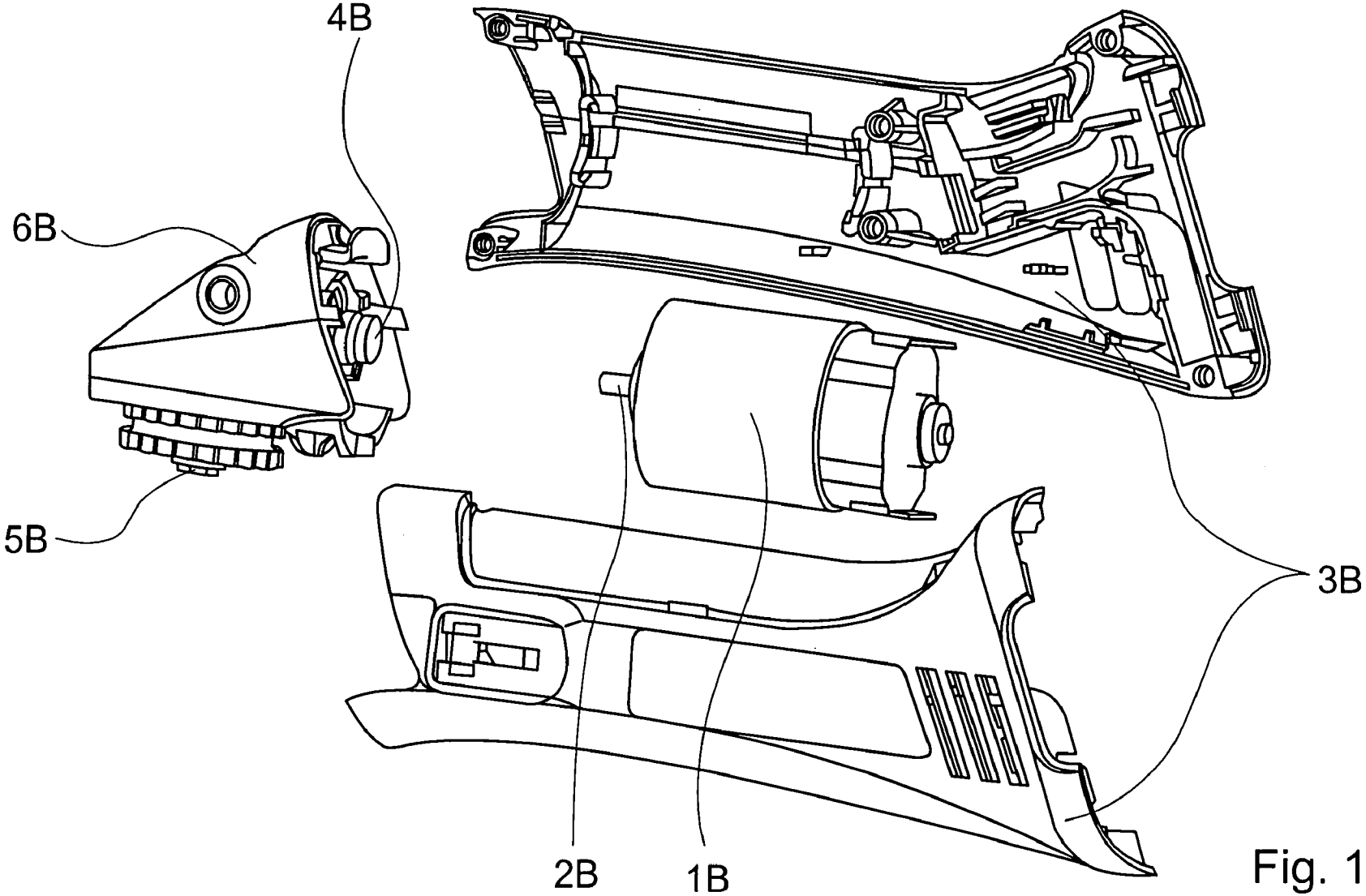
FIG. 1B is a view showing an exemplary embodiment of an angle grinder of modular construction with a shell housing.

Description of FIG. 1B:

FIG. 1B shows as an exemplary embodiment an angle grinder of modular construction. The motor (1B) is supported completely as a unit ("cam motor") and is also usable outside the motor housing (3B).

The gear has a drive shaft (4B) and a power takeoff shaft (5B), which are each supported in the gearbox (6B). The gear can thus be operated independently of the motor (1B).

The armature shaft (2B) of the motor and the drive shaft (4B) of the gear are connected by a suitable coupling. This coupling could for instance be designed as a safety coupling that interrupts the drive train if the power takeoff shaft (work spindle) is for instance suddenly blocked. This coupling will not be described in further detail here.

Figure 1C:
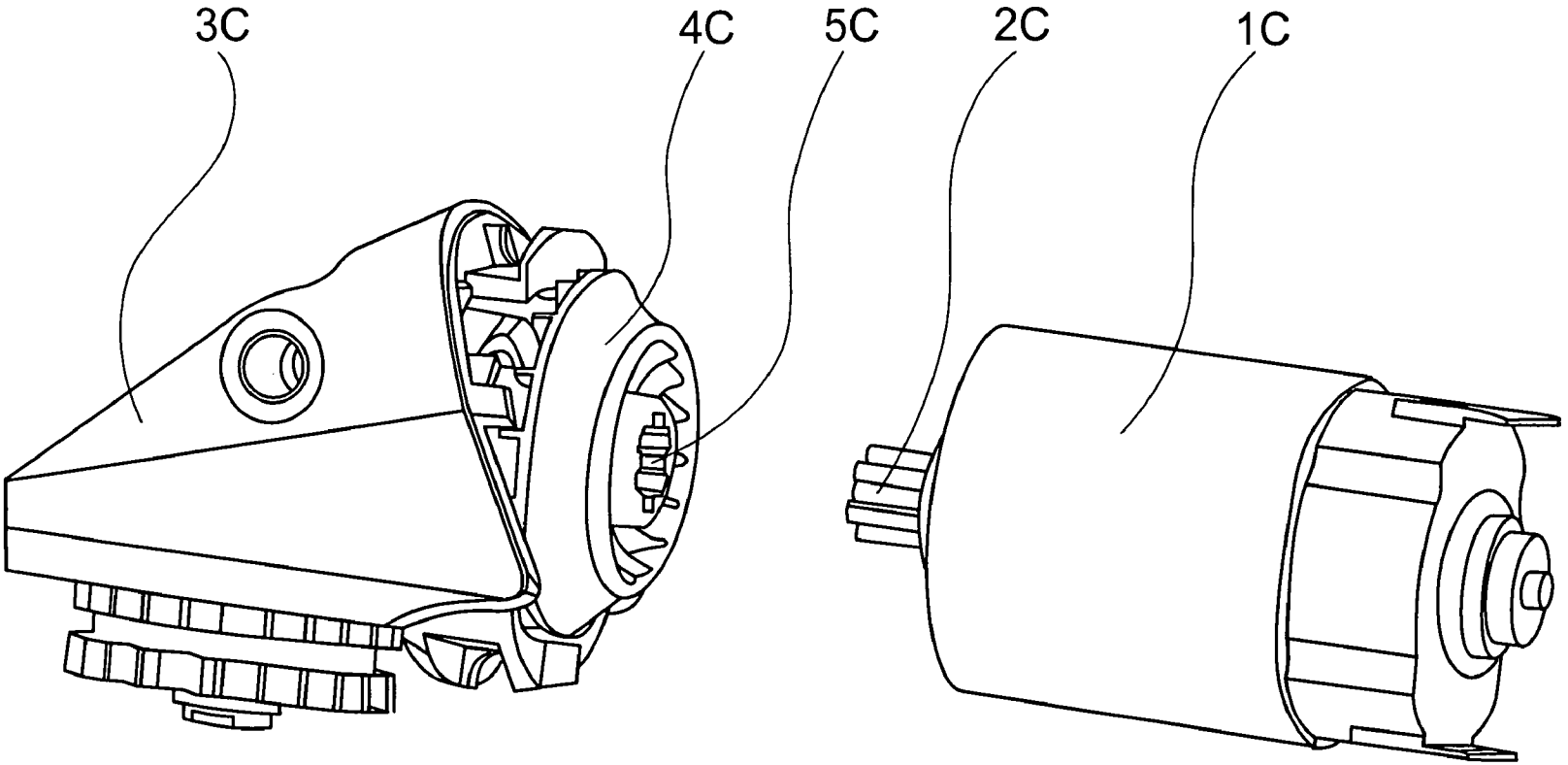
FIG. 1C is a view showing a modular construction of the elected tool with a motor and an angle grinder independently functional as separate component groups.

Description of FIGS. 1C through 3C:

FIG. 1C shows the modular construction of an electric tool, taking an angle grinder as an example. The motor (1C) and the angle grinder (3C) are independently functional as separate component groups. The coupling comprises the toothed bush (2C), which is connected by nonpositive and/or positive engagement to the armature shaft of the motor (1C), and the internal toothing (5C) that is integrated with the fan (4C). The fan (4C) is in turn connected to the gear input shaft by nonpositive and/or positive engagement.

The internal toothing (5C) and the toothed bush (2C) are dimensioned such that between them a defined running play is created in the radial direction, which makes it possible to compensate for an axial offset between the armature shaft and the gear input shaft. The toothed bush (2C) is furthermore shaped spherically, to enable compensating for an angular offset between the two shafts.

Figure 2C:
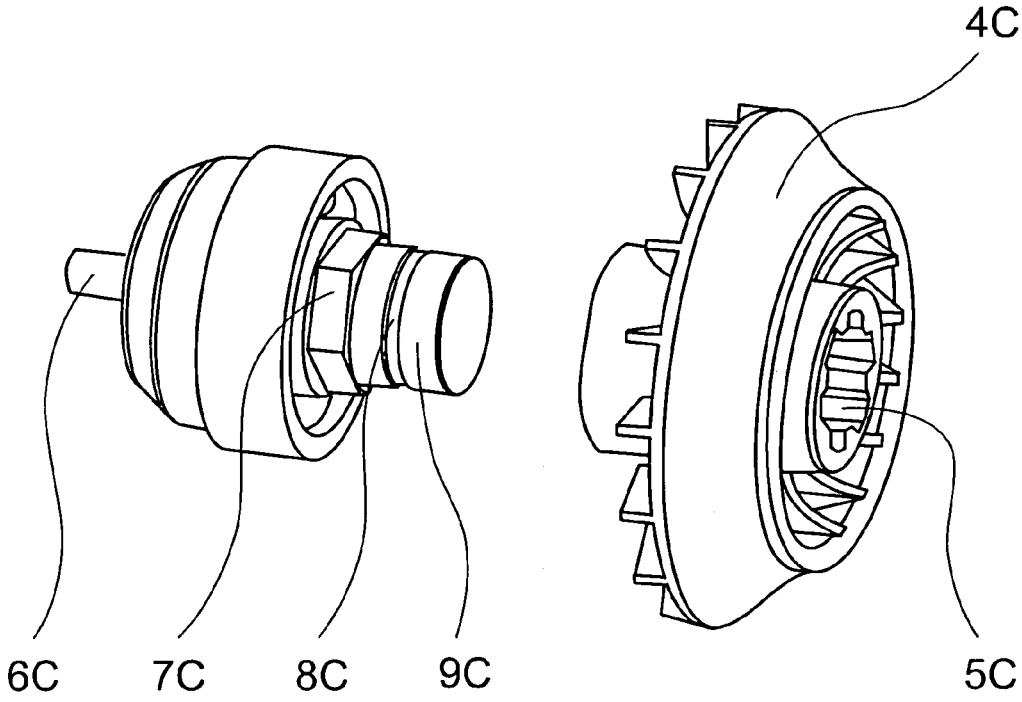
FIG. 2C is a view showing a fan with an internal toothing and a gear input shaft of inventive tool.

FIG. 2C shows the fan (4C) with internal toothing (5C) and the gear input shaft (6C). The gear input shaft (6C), on its end toward the fan, has a hexagon (7C) as well as a cylindrical part (9C) with a plunge cut (8C).

Figure 3C:
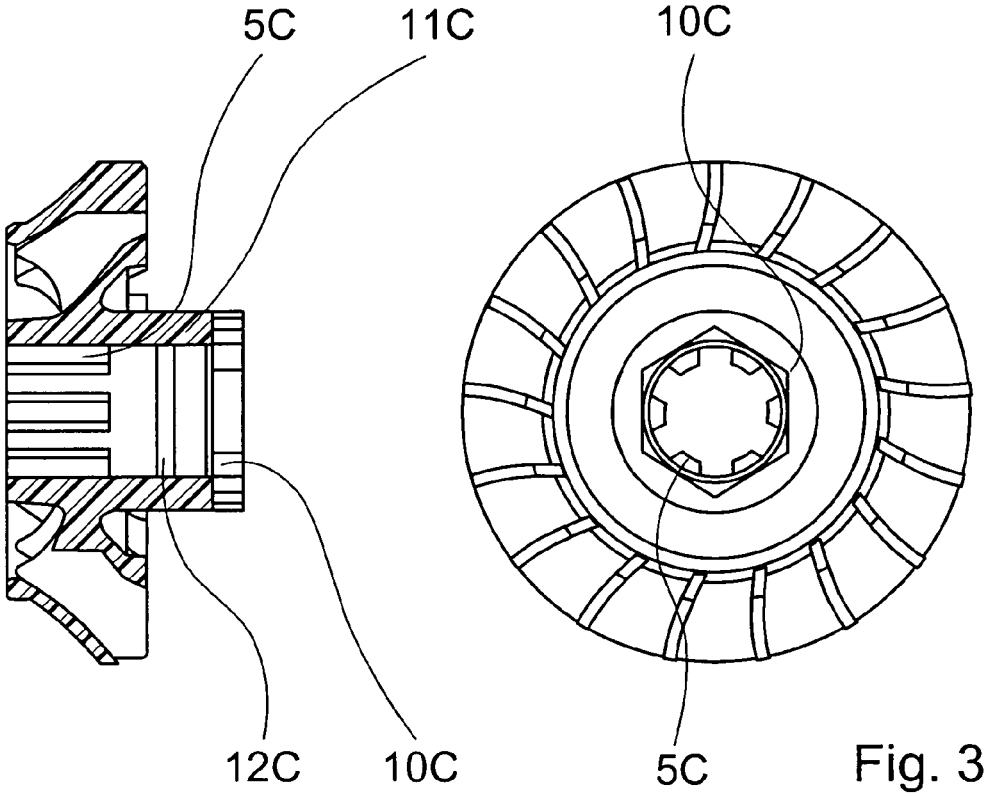
FIG. 3C shows a fan on a gear with a hexagonal socket and a cylindrical joining face.
Figure 3:
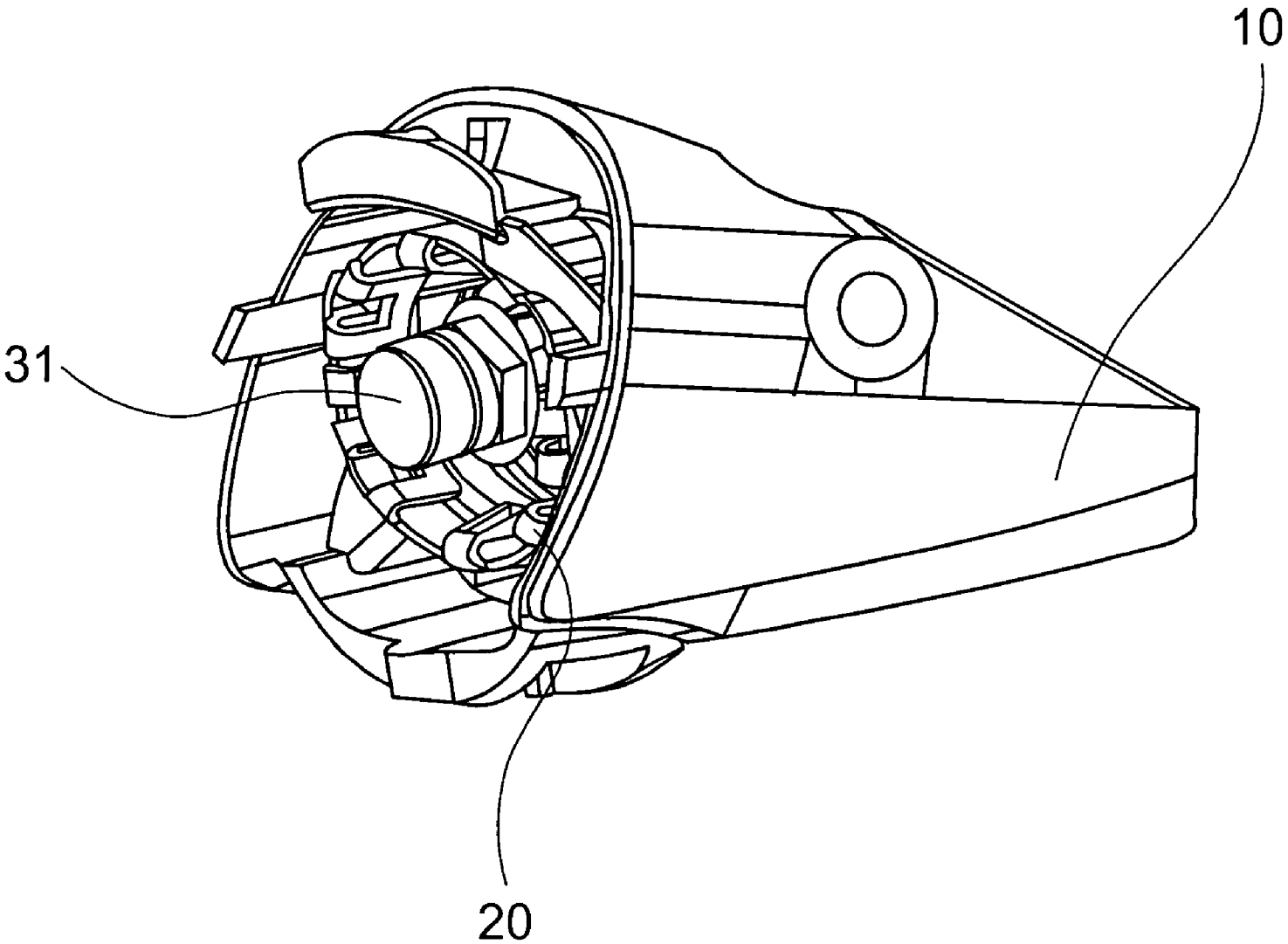
FIG. 3 is a view substantially corresponding to the view of FIG. 2, and additionally showing a pinion shaft of the subsidiary component group inserted in the assembled gear box with the fan guide wheel.
Figure 4:
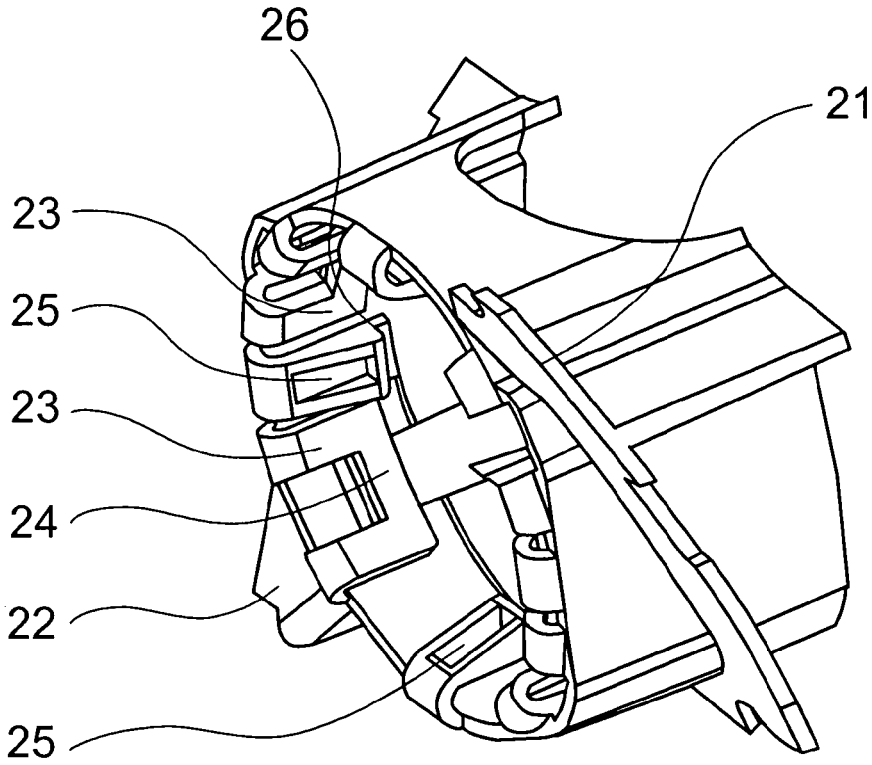
FIG. 4 is a perspective view of the fan gear showing its components.

FIG. 3C shows the fan (4C), which on the gear side has a corresponding hexagonal socket (10C) and a cylindrical joining face (11C). Located inside the joining face (11C) is a ring (12C), with a slightly smaller inside diameter than that of the cylindrical joining face (11C), and it protrudes beyond that face radially inward.

For assembly, the fan (4C) is received in its internal toothing (5C) and is pressed over the cylindrical part (9C) of the gear shaft. By utilization of the elastic properties of the plastic material, the inner ring (12C) becomes seated in the corresponding plunge cut (8C) in the gear shaft and thus serves to secure the fan (4C) axially on the shaft. Simultaneously, the hexagonal socket (10C) of the fan (4C) engages the shaft via the hexagon (7C). The transmission of torque from the fan (4C) to the gear input shaft is thus effected by both nonpositive and positive engagement.

The invention claimed is:

1. A power tool, in particular a right-angle grinder, comprising:

a housing;

a motor that is an independent, fully functional component group which is supported in said housing via a damping unit; and a gear that is an independent, fully functional component group that is configured to be combined with other component groups;

wherein said gear comprises a gear box and a gear input shaft supported in said gearbox via at least one detent connection, wherein said gear comprises a fan guide wheel, that forms said unit to fix said gear input shaft in said gearbox, and a subsidiary component group that comprises a pinion shaft, a pinion, a ball bearing, and a fan, wherein said fan guide wheel is pressed into said gearbox and fixed with tabs, wherein said tabs correspond with hooks on said gearbox to form said at least one detent connection to fix said unit embodied as said fan guide wheel in said gearbox, and wherein said subsidiary component group is clipped into said fan guide wheel to form said gear together with said gearbox, wherein said motor and said gear are connected via a coupling, wherein said coupling comprises a toothed bush, wherein said toothed bush is connected by non-positive, positive, or a combination of positive and non-positive engagement to an armature shaft of said motor, wherein said coupling further comprises an internal toothing that is integrated with said fan which is press-fitted onto the gear input shaft, wherein said toothed bush comprises radial extensions extending perpendicular to a rotation axis of the toothed bush, wherein the radial extensions are uniformly arranged along a circumferential direction of the toothed bush which extends in a plane perpendicular to the rotation axis, wherein said radial extensions are provided for engagement with said internal toothing, wherein said internal toothing and said toothed bush are dimensioned such that between the internal toothing and said toothed bush, defined running play is formed in a radial direction that is perpendicular to said rotation axis of said toothed bush to compensate an axial offset between said armature shaft and said gear input shaft, and wherein said toothed bush is shaped spherical to enable compensating for an angular offset between said armature shaft and said gear input shaft.

2. The power tool of claim 1, wherein the gear input shaft is supported two-fold in the gearbox.

3. The power tool of claim 1, wherein the gear input shaft is fixed via a detent connection in a unit fixed in the gearbox.

4. The power tool of claim 1, wherein the damping unit includes at least one rubber ring.

5. The power tool of claim 1, wherein the motor and the gear are connected via a male coupling.

6. The power tool of claim 1, wherein the gear input shaft has a hexagonal part and a cylindrical part with a plunge cut.

7. The power tool of claim 1, wherein the fan has a hexagonal socket and a cylindrical joining face, wherein a ring with a smaller inside diameter than that of the cylindrical joining face is located inside the joining face.

8. The power tool of claim 1, wherein said fan guide wheel covers hollow chambers in said gearbox to direct a cooling air of said motor to air outlet openings in said gearbox.

9. The power tool of claim 1, wherein said fan guide wheel axially secures said ball bearing in said gearbox in a mounted state.

10. The power tool of claim 1, wherein said subsidiary component group is surrounded by said gearbox.

11. The power tool of claim 1, wherein said coupling is a safety coupling provided to interrupt a junction between an armature shaft of said electric motor and a drive shaft of said gear.

12. A right-angle grinder gear, comprising:

a gearbox;

a gear input shaft that is supported two-fold in said gearbox;

a fan guide wheel; and a subsidiary component group that comprises a pinion shaft, a pinion, a ball bearing and a fan;

wherein said gear is embodied as an independent, fully functional component group, wherein said gear input shaft is fixed in said gearbox via a unit that is fixed in said gearbox via at least one detent connection, wherein said fan guide wheel forms said unit to fix said gear input shaft in said gearbox, wherein said gear is provided to be coupled to an electric motor which is embodied as an independent, fully functional component group, and which is supported in a housing of a power tool via a damping unit, wherein said fan guide wheel is pressed into said gearbox and fixed with tabs, wherein said tabs correspond with hooks on said gearbox to form said at least one detent connection to fix said unit embodied as said fan guide wheel in said gearbox, and wherein said subsidiary component group is clipped into said fan guide wheel to form said gear together with said gearbox, wherein said motor and said gear are connected via a male coupling, wherein said coupling comprises a toothed bush, wherein said toothed bush is connected by non-positive, positive, or a combination of positive and non-positive engagement to an armature shaft of said motor, wherein said coupling further comprises an internal toothing that is integrated with said fan which is press-fitted onto a gear input shaft, wherein said toothed bush comprises radial extensions extending perpendicular to a rotation axis of the toothed bush, wherein the radial extensions are uniformly arranged along a circumferential direction of the toothed bush which extends in a plane perpendicular to the rotation axis, wherein said radial extensions are provided for engagement with said internal toothing, wherein said internal toothing and said toothed bush are dimensioned such that between said internal toothing and said toothed bush a defined running play is formed in a radial direction that is perpendicular to said rotation axis of said toothed bush to compensate an axial offset between said armature shaft and said gear input shaft, and wherein said toothed bush is shaped spherical to enable compensating for an angular offset between said armature shaft and said gear input shaft.

13. A power tool in the form of an angle grinder, comprising:

a housing;

a motor that is embodied as an independent, fully functional component group which is supported in said housing via a damping unit;

a subsidiary component group that comprises a pinion shaft, a pinion, a ball bearing and a fan; and a gear that is embodied as an independent, fully functional component group configured to be combined with other component groups, wherein said motor and said gear are connected via a coupling, wherein said coupling comprises a toothed bush, wherein said toothed bush is connected by non-positive, positive or a combination of positive and non-positive engagement to an armature shaft of said motor, wherein said coupling comprises an internal toothing that is integrated with a fan which is press-fitted onto a gear input shaft of said gear, wherein said toothed bush comprises radial extensions extending perpendicular to a rotation axis of the toothed bush, wherein the radial extensions are uniformly arranged along a circumferential direction of the toothed bush which extends in a plane perpendicular to the rotation axis, wherein said radial extensions are provided for engagement with said internal toothing, wherein said internal toothing and said toothed bush are dimensioned such that between them, a defined running play is created in a radial direction to compensate an axial offset between said armature shaft and said gear input shaft, and wherein said toothed bush is shaped spherical to enable compensating for an angular offset between said armature shaft and said gear input shaft.

* * * * *